US005398392A

United States Patent [19]

Sano et al.

[11] Patent Number: 5,398,392

[45] Date of Patent: Mar. 21, 1995

[54] APPARATUS FOR TREATING YARN WITH FLUID

[75] Inventors: Takao Sano, Moriyama; Hiroshi Tsubakimori, Otsu, both of Japan

[73] Assignee: Toray Industries, Inc., Tokyo, Japan

[21] Appl. No.: 143,134

[22] Filed: Oct. 29, 1993

[30] Foreign Application Priority Data

Nov. 2, 1992 [JP] Japan ..... 4-294168
Nov. 4, 1992 [JP] Japan ..... 4-294927
Nov. 5, 1992 [JP] Japan ..... 4-295585

[51] Int. Cl.[6] ..... D02J 1/08
[52] U.S. Cl. ..... 28/276; 28/274
[58] Field of Search ..... 28/274, 275, 276, 271

[56] References Cited

U.S. PATENT DOCUMENTS 2,985,995 5/1961 Bunting et al. .
3,115,691 12/1963 Bunting et al. .
3,262,179 7/1966 Sparling .
3,727,275 4/1973 Ohayon ..... 28/276 X
4,070,815 1/1978 Negishi et al. ..... 28/276 X
4,949,441 8/1990 Ethridge ..... 28/275 X
5,079,813 1/1992 Agers et al. ..... 28/274

FOREIGN PATENT DOCUMENTS 52-44689 10/1977 Japan .
59-66532 4/1984 Japan .
61-194243 8/1986 Japan .

*Primary Examiner*—John J. Calvert
*Attorney, Agent, or Firm*—Birch, Stewart, Kolasch & Birch

[57] ABSTRACT

An apparatus for treating yarn with fluid which is designed to allow a yarn consisting of an as-spun multifilament to run between first and second components which have inner walls arranged facing against each other with a specified gap provided between them and to interlace the filaments by a fluid in order to provide the yarn with coherence. The first and second components are provided with at least one fluid conduit which is opened in their inner walls. These fluid conduits form a yarn treating region with axes of the fluid conduits and the inner walls of the first and second components. These fluid conduits are provided between the axes of the fluid conduits with a specified distance between them in a section which is substantially orthogonal with a running direction of the yarn and are arranged aslant so that the fluid ejected from the fluid conduits is directed to the yarn treating region.

13 Claims, 15 Drawing Sheets

APPARATUS FOR TREATING YARN WITH FLUID

BACKGROUND OF THE INVENTION

1. Field of the Invention

The present invention relates to an apparatus for interlacing the filaments of a yarn, which consists of a multifilament, by the effect of a fluid, thereby providing the yarn with high coherence.

2. Description of Related Art

A yarn consisting of an as-spun or zero twist multifilament is interlaced mainly because of its difficult handling due to poor coherence.

As an apparatus for interlacing an as-spun yarn by the effect of a fluid, the ones disclosed under U.S. Pat. No. 3,115,691, Unexamined Japanese Patent Publication (KOKAI) No. 61-194243, and Unexamined Japanese Patent Publication No. 59-66532 are known.

In these treating apparatuses, the one disclosed in U.S. Pat. No. 3,115,691, for example, as shown in FIG. 36, which is a cross-sectional drawing orthogonal with the yarn running direction, one component $B_1$ of the two components $B_1$ and $B_2$, which interlace yarn, is provided with fluid conduits $P_1$ and $P_1$, which are inclined against each other toward the inner wall of the other component $B_2$. Or as shown in FIG. 37 which is a similar cross-sectional drawing, one component $B_1$ is provided with fluid conduits $P_2$ and $P_2$, which eject a fluid toward the inner wall of the other component $B_2$, so that they are in parallel to each other and are orthogonal with the inner wall.

Further in this treating apparatus, a yarn to be interlaced is allowed to run between the components $B_1$ and $B_2$, and a fluid is ejected from the fluid conduits $P_1$ and $P_1$ toward the other component $B_2$, thus interlacing the yarn by the effect of the fluid. The fluid conduits are provided only in one of the components.

In addition, a treating apparatus which has two facing components, each thereof being provided with an fluid conduit, is disclosed in FIG. 3 and FIG. 38 of U.S. Pat. No. 2,985,995. Both these apparatuses have a pair of facing fluid conduits which share a common axis and produce a colliding jet which interlaces the fibers constituting the multifilament yarn.

In these conventional apparatuses, how frequently the multifilament yarn is exposed to the colliding jet produced by the facing fluid conduits is an important key for achieving efficient treating apparatuses, and the geometric configurations and actual dimensions of the inner wall surfaces of the two components, which configure the yarn treating region, are therefore important.

In the treating apparatus described above, the yarn is interlaced by a fluid ejected from the fluid conduits provided in one of the two components. Therefore, the yarn to be treated is interlaced while it vibrates two-dimensionally between the two fluid conduits. Hence, it is necessary to enhance the frequency of the exposure of the yarn, which is to be interlaced, to the fluid ejected from the fluid conduits, the resulting coherence of the yarn depending on the exposure frequency.

In the conventional treating apparatus shown in FIG. 11 and FIG. 12 of U.S. Pat. No. 3,115,691 described above, the yarn, which is interlaced by the fluid ejected from the fluid conduits, tends to jump out of the ejecting fluid because of the two-dimensional vibration, presenting a problem that the yarn partially misses interlacing.

Furthermore, in the aforesaid conventional colliding jet type apparatus, the filaments constituting the multifilament yarn are positively exposed to the colliding jet by contacting with and bouncing against the inner wall of the two components.

Hence, the material and surface treatment condition significantly influence the quality factors of yarn such as frays, strength, and elongation percentage.

Therefore, (1) the apparatus is not suited for a yarn manufacturing process for semi-drawn yarns, such as POY (pre-oriented yarn), tire cords or the like for which maximum efforts should be made to avoid causing deterioration in yarn quality.

In addition, (2) the apparatus is not capable of providing wide, flat yarns such as staple and tow with coherence while maintaining their flatness intact because the flatness is crushed at interlaced points.

Especially, the apparatus disclosed in FIG. 3 and FIG. 38 of U.S. Pat. No. 2,985,995 is intended to provide a multifilament yarn with coherence (interlacing). However, it is not designed to interlace flat yarns such as staple and tow while maintaining their flatness intact. More specifically, in this apparatus, the yarn after it is interlaced presents an approximately circular cross section; therefore, the apparatus has a disadvantage in v that it cannot maintain the original flatness of the yarn.

Also, since the fluid ejected from the fluid conduits is used for interlacing yarns, it is necessary to accomplish the most effective use of the potential energy, i.e., the dynamic pressure, that the fluid has.

The conventional treating apparatuses, however, are not satisfactory in the aspects of increasing the frequency of exposing yarn to the fluid and of the efficient use of the dynamic pressure of the fluid.

Furthermore, Examined Japanese Utility Model Publication (KOKOKU) No. 52-44689 discloses a treating apparatus which uses the same components facing against each other and has a plurality of fluid conduits, but the axes of the fluid conduits are not shared or crossed.

This apparatus, however, is designed to twist a yarn by positively generating a revolving stream in a treating region, which has a circular cross section, and therefore it provides a multifilament yarn, which continuously runs, with false-twisting. Accordingly, the apparatus utterly differs, in the objects and the obtained form of yarn, from the treating apparatus designed to provide a yarn with coherence which is an object of the present invention.

SUMMARY OF THE INVENTION

The first object of the present invention is to provide an apparatus for treating yarn with fluid suited for a yarn manufacturing process which needs to avoid causing deterioration in yarn quality as much as possible.

The second object of the present invention is to provide an apparatus for treating yarn with fluid which is capable of interlacing flat yarns consisted of a multifilament while maintaining their flatness intact.

A common object of the present invention is to provide an apparatus for treating yarn with fluid which is designed to restrain a yarn to be interlaced from jumping out of the fluid ejected from fluid conduits, thereby increasing the frequency of the exposure of the yarn to the fluid and presenting good interlacing performance.

A further object of the present invention is to provide an apparatus for treating yarn with fluid which is designed to utilize the dynamic pressure of the fluid, which interlaces yarns, as effectively as possible, thereby enhancing the efficiency of the use of the dynamic pressure which the fluid has.

To accomplish the above-mentioned objects, the inventors observed the relationships obtained between the fluid ejected from fluid conduits and the yarns interlaced by the fluid, with different layouts of the fluid conduits, and carefully studied the relationships from the viewpoint of the layout of the fluid conduits.

The inventors discovered a fact that the best result is obtained when the axes of the fluid conduits formed in both the first and second components are shifted against each other and inclined against each component so that the fluid is ejected toward a yarn treating region, which is formed in a section substantially orthogonal with the yarn running direction.

To be specific, when the fluid conduits formed both in the first and second components are arranged as described above, the fluid ejected from these fluid conduits and the inner walls of the first and second components form a yarn treating region. The inventors found that when a yarn consisting of an as-spun multifilament is allowed to pass through the yarn treating region, the encountering frequency of the yarn and the fluid increases in interlacing the filaments, the coherence of the yarn improves and the yarn is effectively restrained from jumping out of the yarn treating region, thus permitting effective utilization of the dynamic pressure of the fluid.

The present invention has been accomplished based on the knowledge described above. According to the first invention of the present invention, an apparatus for treating yarn with fluid which is designed to allow a yarn consisting of an as-spun multifilament to run between first and second components, which have inner walls arranged facing against each other with a specified gap provided between them, and to interlace said filaments by a fluid in order to provide said yarn with coherence, wherein said first and second components are provided with at least one fluid conduit opened in each of said inner walls, said fluid conduits form a yarn treating region with axes of said fluid conduits and said inner walls of said first and second components, a specified distance is provided between said axes of said fluid conduits in a section which is substantially orthogonal with a running direction of said yarn, and said fluid conduits are inclined so that said fluid ejected from said fluid conduits is directed toward said yarn treating region.

According to the apparatus described above, the yarn to be interlaced does not jump out of the yarn treating region and the frequency of encounter between the yarn and the fluid is increased, resulting in good yarn interlacing performance.

Further according to the apparatus described above, the quality of the yarn to be interlaced is not deteriorated.

Still further according to the apparatus described above, the fluid ejecting from the fluid conduits is directed toward the yarn treating region, permitting effective utilization of the dynamic pressure of the fluid.

Preferably, said inner walls of said first and second components have flat surfaces which constitute a major part of said yarn treating region.

Further preferably, said fluid conduits are oriented so that they are substantially orthogonal with said running direction of said yarn in a section in said running direction of said yarn.

Still preferably, said fluid conduits are located aslant to said running direction of said yarn in a section in said running direction of said yarn.

Yet preferably, said inner walls of said first and second components are provided with projections which jut out toward their associated inner walls at portions adjoining said major part constituting said yarn treating region in a section which is substantially orthogonal with said running direction of said yarn.

Preferably, said first and second components are provided with at least one sub fluid conduit for ejecting a fluid to said yarn treating region, which sub fluid conduits are provided between axes of said fluid conduits and which are arranged in parallel to and face against said fluid conduits in a section which is substantially orthogonal with said running direction of said yarn.

Further preferably, said inner walls of said first and second components have flat surfaces which constitute said major part of said yarn treating region.

Preferably, said fluid conduits and sub fluid conduits are oriented so that they are substantially orthogonal with said running direction of said yarn in a section in said running direction of said yarn.

Preferably, said fluid conduits and sub fluid conduits are located aslant to said running direction of said yarn in a section in said running direction of said yarn.

In addition, according to the second invention of the present invention, an apparatus which is designed to allow a yarn consisting of an as-spun multifilament to run between first and second components which have inner walls located facing against each other with a specified gap provided between them and to interlace said filaments with each other by a fluid, thereby providing said yarn with coherence, wherein said first and second components are provided with a plurality of fluid conduits for ejecting said fluid in a section, which is substantially orthogonal with a running direction of said yarn, said fluid conduits are opened in said respective inner walls, arranged facing against each other, and formed between axes of adjoining fluid conduits in parallel with a specified distance provided between them.

According to the apparatus described above, an effect is obtained which makes it possible to interlace a flat yarn while maintaining its flatness intact in addition to the effect provided by the first embodiment present invention.

Preferably, said plurality of fluid conduits are provided with their axes displaced so that said fluid conduits facing against each other share an overlapping area in a plane of projection which is perpendicular to said axial directions of respective fluid conduits.

Further preferably, a size of said common area ranges from 50% to 100% of said projected area of said respective fluid conduits.

Preferably, said inner walls, in which said plurality of fluid conduits are opened, of said first and second components are flat surfaces.

Further preferably, each of said first and second components has an additional fluid conduit for jetting said fluid toward said yarn, which additional fluid conduit is provided outside said plurality of fluid conduits facing against each other.

According to a preferable aspect described above, the performance of the apparatus according to the present invention described above is further improved.

The above and other objects, characteristics, and advantages of the present invention will become more apparent from the following detailed description taken in connection with the accompanying drawings.

BRIEF DESCRIPTION OF THE DRAWINGS

This present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The following gives a detailed explanation of the first embodiment of the first invention of the present invention with reference to FIG. 1 through FIG. 12.

Figure 1:
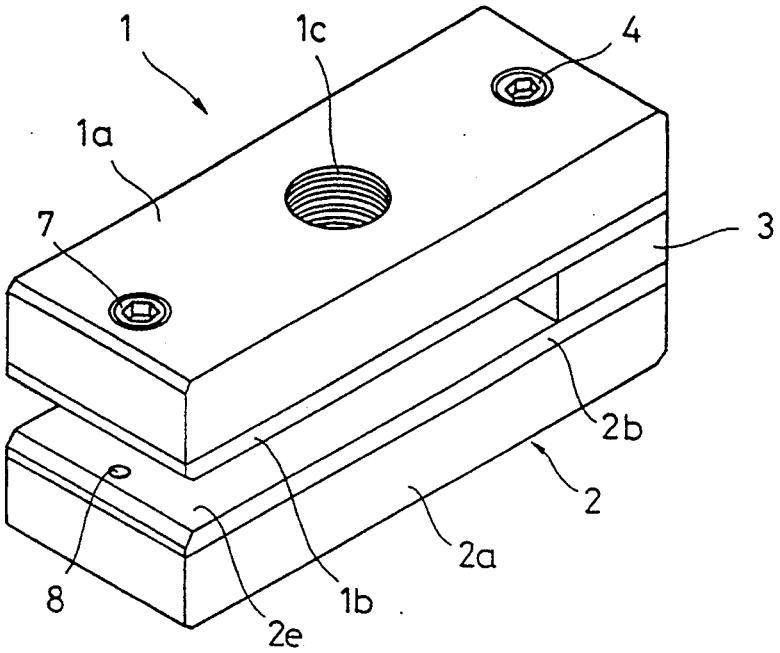
FIG. 1 is a perspective view of an apparatus for treating yarn with fluid related to the first embodiment of the first invention of the present invention.
Figure 2:
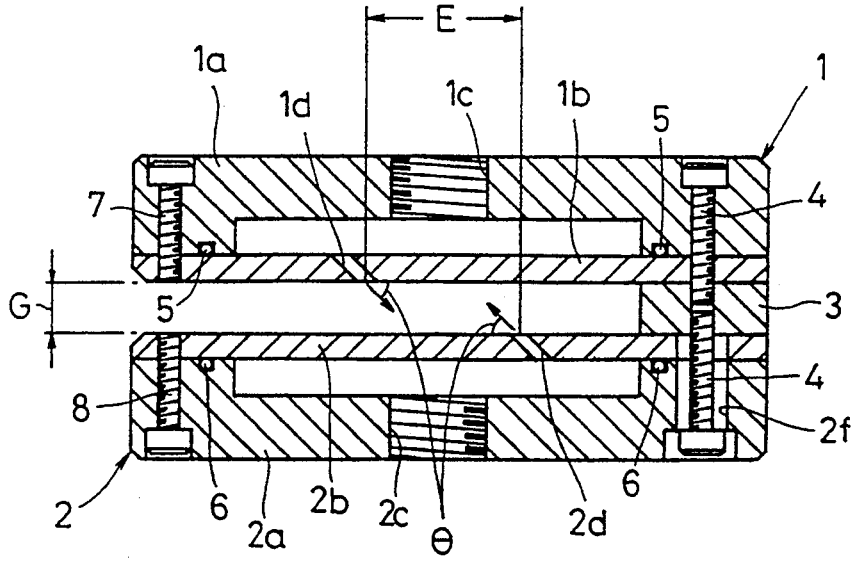
FIG. 2 is a front view which shows the section of the apparatus of FIG. 1.
Figure 3:
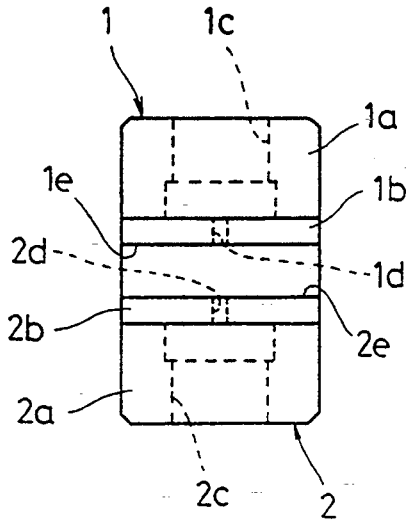
FIG. 3 is a left side view of the apparatus of FIG. 1.

In the apparatus for treating yarn with fluid of the embodiment, the first component 1 and the second component 2 are fixed with bolts 4 and 4 via a spacer 3 as shown in FIG. 1 through FIG. 3.

As shown in FIG. 2 illustrating a section which is substantially orthogonal with the running direction of a yarn, in the first component 1 and the second component 2, nozzle plates 1*b* and 2*b* are mounted on main bodies 1*a* and 2*a* with bolts 4 and 7 and bolts 4 and 8 via sealing materials, e.g., O rings 5 and 6. The main bodies 1*a* and 2*a* are provided with connection holes 1*c* and 2*c*, and the nozzle plates 1*b* and 2*b* are .provided with fluid conduits 1*d* and 2*d*.

Figure 4:
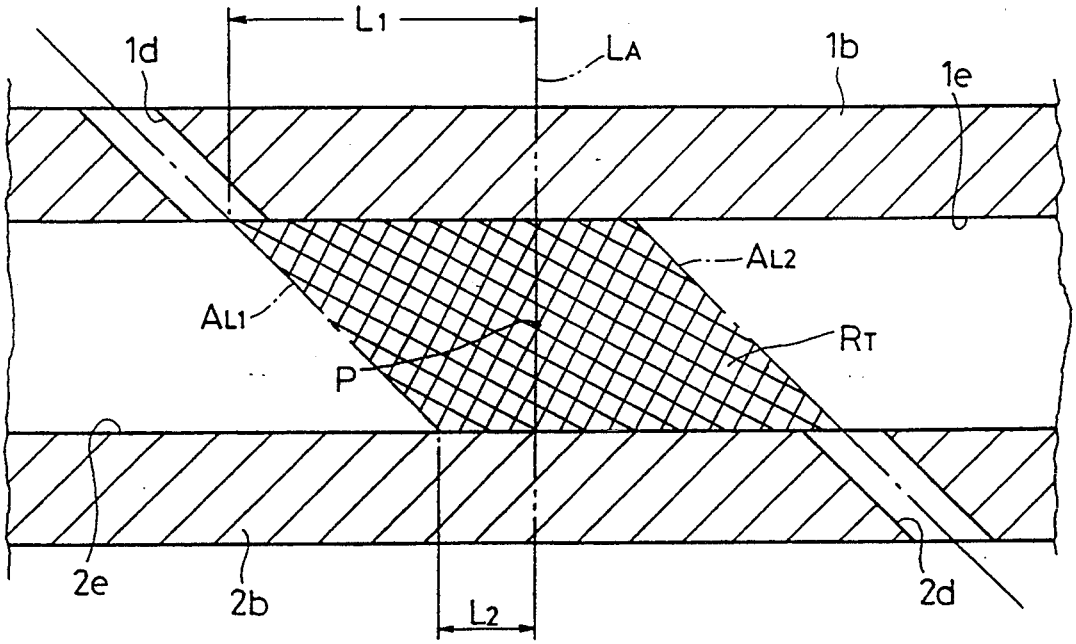
FIG. 4 is an enlarged view which shows the relationship between the fluid conduits provided in the nozzle plates of the apparatus for treating yarn with fluid and a yarn treating region.

As shown in FIG. 4, the fluid conduits 1*d* and 2*d* are opened in the inner walls 1*e* and 2*e* of the nozzle plates 1*b* and 2*b*. The inner walls 1*e* and 2*e* of the nozzle plates 1*b* and 2*b* and the axes $A_{L1}$ and $A_{L2}$ of the fluid conduits 1*d* and 2*d* form a yarn treating region $R_T$ for interlacing a yarn. The fluid conduits 1*d* and 2*d* are spaced away from each other by the distance E (see FIG. 2) defined by the axes $A_{L1}$ and $A_{L2}$ and they are inclined so that they eject fluid toward the yarn treating region $R_T$.

The following presents further details of the inclined fluid conduits 1*d* and 2*d* with reference to FIG. 4.

For example, regarding the fluid conduit 1*d*, an auxiliary line $L_A$ which passes through an intersection P of the diagonal line and which is orthogonal with the inner walls 1*e* and 2*e* of the nozzle plates 1*b* and 2*b* is drawn in the parallelogrammatic yarn treating region $R_T$ of FIG. 4.

The distance from the point at which the axis $A_{L1}$ of the fluid conduit 1*d* intersects with the inner wall 1*e* of the nozzle plate 1*b* to the auxiliary line $L_A$ is defined as $L_1$ and the distance from the point at which the axis $A_{L1}$ of the fluid conduit 1*d* intersects with the inner wall 2*e* of the nozzle plate 2*b* to the auxiliary line $L_A$ is defined as $L_2$.

At this time, if the fluid conduit 1*d* is formed so that the distances $L_1$ and $L_2$ have a relationship of $L_1 > L_2$, then the fluid ejected from the fluid conduit 1*d* will be directed toward the yarn treating region $R_T$.

The aforementioned relationship $L_1 > L_2$ is true with the fluid conduit $2_d$, and it is also true with the second embodiment related to the first invention and the second invention of the present invention to be explained below.

Hence, as shown in FIG. 2, regarding the fluid conduits 1*d* and 2*d* in the nozzle plates 1*b* and 2*b*, an angle $\theta$ formed by the inner walls, which constitute the major part of the yarn treating region $R_T$ (see FIG. 4), and the axes $A_{L1}$ and $A_{L2}$ is 90° or less.

In the apparatus for treating yarn with fluid, the yarn consisting of a multifilament running through the yarn treating region $R_T$ usually exhibits lateral chord vibration in FIG. 2. For this reason, in FIG. 2, even if the yarn to be interlaced behaves two-dimensionally due to the fluid ejecting from the fluid conduit 2*d* and deflects toward the fluid conduit 1*d* located outside, the yarn will be drawn back into the central yarn treating region $R_T$ by the fluid which ejects from the fluid conduit $1_d$. The same effect applies when the yarn deflects toward the fluid conduit 2*d*.

Likewise, even if yarn tension has dropped extremely, causing a part of the yarn or the whole yarn to move, for example, to the left beyond the axis $A_{L1}$ of the fluid conduit 1*d* in FIG. 2. The yarn is drawn back to the right and moved back to the central yarn treating region $R_T$ in FIG. 2 by the fluid ejecting from the fluid conduit 1*d* because the fluid conduit 1*d* is inclined.

Similarly, even if a part of the yarn or the whole yarn moves to the right beyond the axis $A_{L2}$ of the fluid conduit 2*d*, the yarn is moved back to the central yarn treating region $R_T$ by the fluid jetting from the fluid conduit 2*d*.

Thus, in the apparatus described above, the yarn running through the yarn treating region $R_T$ exhibits extremely self-stable chord vibration behavior in which it shuttles between the fluid conduit 1*d* and the fluid conduit 2*d*.

By such a drawing-back effect, the yarn which is interlaced laterally vibrates through the yarn treating region $R_T$ between the fluid conduits 1*d* and 2*d* in FIG. 2 and it is effectively provided with opened portions and interlaced portions by the fluid ejected from the fluid conduits 1*d* and 2*d*, thereby turning into a yarn with a high level of coherence.

Figure 5:
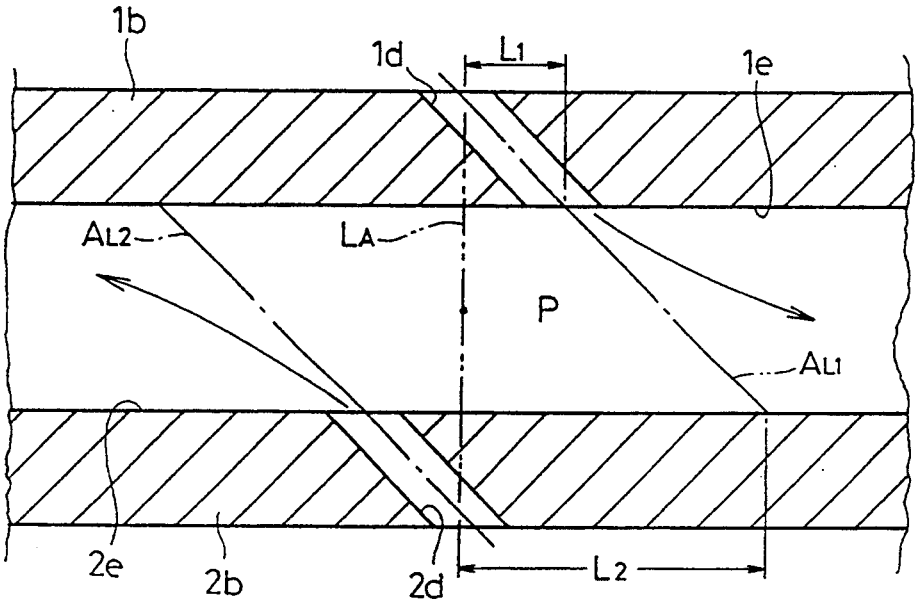
FIG. 5 is an enlarged view which shows the fluid conduits provided in the nozzle plates of the apparatus, the orientation of the fluid conduits being opposite from that shown in FIG. 4.

In this case, the effect described above cannot be obtained if the direction of the inclination of the fluid conduits 1*d* and 2*d* is reversed from that described above. To be more specific, as shown in FIG. 5, if the axes $A_{L1}$ and $A_{L2}$ of the fluid conduits 1*d* and 2*d* are inclined in the opposite directions from those mentioned above so that the relationship of the distances $L_1$ and $L_2$ from the auxiliary line $L_A$ is changed to $L_1 < L_2$, then the ejecting fluid is directed away from the yarn treating region $R_T$ as shown by the arrowheads, failing to provide the yarn with opened and interlaced portions.

The second component 2 has a long inserting hole 2*f* for inserting the bolts 4 of the main body 2*a* and the nozzle plate 2*b*. This makes it possible to adjust a distance E (see FIG. 2) between the axes $A_{L1}$ and $A_{L2}$ of the fluid conduits 1*d* and 2*d* in the horizontal direction in the apparatus of this embodiment.

In the apparatus described above, pressurized air is supplied to the connection holes 1*d* and 2*d* from a fluid supplying source like a pressurized air source, not shown, while allowing the yarn, which is to be interlaced, to run through the pap formed by the first and second components 1 and 2. Then the pressurized air passes through the fluid conduits 1*d* and 2*d* and ejects as shown by the arrowheads in FIG. 2.

Thus, the yarn is effectively interlaced by the pressurized air, which ejects out through the fluid conduits 1*d* and 2*d*, in the yarn treating region $R_T$ while it runs between the first and second components 1 and 2.

At this time, the pressurized air ejected from the fluid conduits 1*d* and 2*d* bumps against the inner walls 1*e* and 2*e* of the facing nozzle plates 1*b* and 2*b* without bumping against each other, then it is discharged out of the apparatus along the inner walls 1*e* and 2*e* of the nozzle plates 1*b* and 2*b*. When the pressurized air is discharged, it is rapidly discharged with a high density because there is no obstacles blocking its discharge except the yarn.

Hence, the pressurized air ejected from the fluid conduits 1*d* and 2*d* is allowed to maintain its own high potential energy, thus permitting effective use of the dynamic pressure owned by the pressurized air for interlacing the yarn.

Further, since the pressurized air is rapidly discharged out of the apparatus, the pressurized air for interlacing the yarn is dense in the area where it has ejected from the fluid conduits 1*d* and 2*d* but sparse in the adjoining areas in the section shown in FIG. 2. The presence of the sparse, dense, and sparse areas of the pressurized air further makes it easy to form opened and interlaced portions of the yarn, ensuring effective interlacing of the yarn.

Furthermore, a gap G (see FIG. 2) between the components 1 and 2 can be changed by adjusting the thickness of a spacer 3.

In this case, at least one each of the fluid conduits 1*d* and 2*d* may be provided in each of the components 1 and 2, and the distance E in the horizontal direction between the fluid conduits 1*d* and 2*d* varies depending on the gap G between the first and second components 1 and 2, which face against each other, and the type of yarn to be interlaced.

The fluid conduits 1*d* and 2*d* have, for example, a round section, however, the configuration is not limited to the round section; it is needless to say that its configuration may alternatively be an ellipse or a polygon such as a triangle or quadrangle.

Preferably, the major part, which constitutes the yarn treating region $R_T$, of inner walls 1*e* and 2*e* of the nozzle plates 1*b* and 2*b* facing against each other has a flat plane. This allows the pressurized air ejected from the fluid conduits 1*d* and 2*d* to be smoothly discharged along the inner walls 1*e* and 2*e* of the nozzle plates 1*b* and 2*b* without its flow being blocked. Thus, the loss in the energy of the pressurized air ejected from the fluid conduits 1*d* and 2*d* is minimized and the dynamic pressure of the ejecting pressurized air can be effectively used for interlacing.

Figure 6:
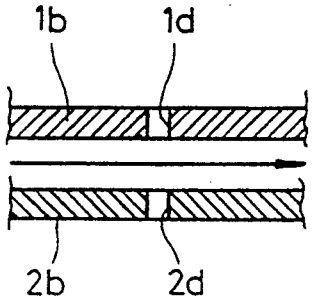
FIG. 6 is a cross-sectional view which schematically shows the fluid conduits which are provided in the nozzle plates of the apparatus and which are oriented so that they are substantially orthogonal with the yarn running direction in the section of the yarn running direction.

Preferably, the fluid conduits 1*d* and 2*d* provided in the nozzle plates 1*b* and 2*b* of the first and second components 1 and 2 are oriented so that they are orthogonal with the yarn running direction as shown by the arrowhead in FIG. 6 in the section in the yarn running direction. Or the fluid conduits 1*d* and 2*d* are oriented aslant to the yarn running direction shown by the arrowhead in FIG. 7. When orienting the fluid conduits 1*d* and 2*d* aslant to the yarn running direction, the fluid conduits 1*d* and 2*d* are made so that the pressurized air is ejected in the yarn running direction as shown by the arrowhead in FIG. 8 which shows the nozzle plate 2*b* observed from above.

Figure 7:
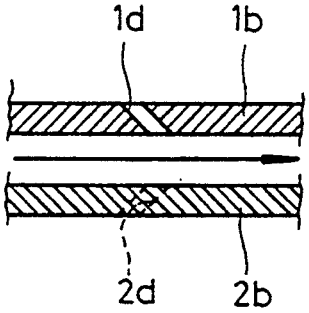
FIG. 7 is a cross-sectional view which schematically shows the fluid conduits which are provided in the nozzle plates of the apparatus and which are inclined against the yarn running direction.
Figure 8:
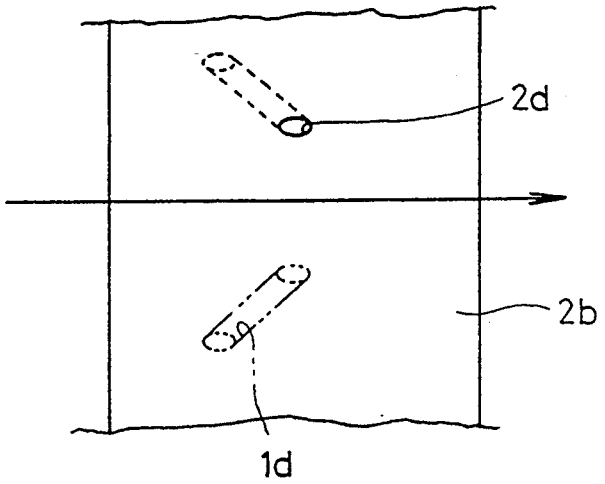
FIG. 8 is an arrangement drawing of the fluid conduits when the nozzle plate of the second component is viewed from above under the condition of FIG. 7.

Since the fluid conduits 1*d* and 2*d* are inclined in the plane which are orthogonal with the yarn running direction as shown in FIG. 2, they cannot be seen like those of FIG. 6 or FIG. 7 in the actual section in the yarn running direction. This means that FIG. 6 and FIG. 7 give schematic models used for the purpose of clearly showing the direction of the inclination of the fluid conduits 1*d* and 2*d* in the section in the yarn running direction. The same applies to FIG. 9, FIG. 16 through FIG. 19, FIG. 21, FIG. 28 through FIG. 32 and FIG. 34.

When the fluid conduits 1*d* and 2*d* are laid out like this, even if the yarn deflects toward one of the fluid conduits 1*d* and 2*d*, the pressurized air ejecting from the other one of the fluid conduits 1*d* and 2*d* draws the yarn back into the central yarn treating region $R_T$ as described previously. Thus the ejecting pressurized air makes it easy for the yarn to laterally vibrate, enhancing the coherence of the yarn.

Figure 9:
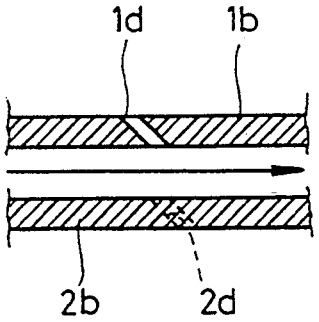
FIG. 9 is an another cross-sectional view which schematically shows the fluid conduits which are provided in the nozzle plates of the apparatus and which are inclined against the yarn running direction in the section of the yarn running direction.
Figure 10:
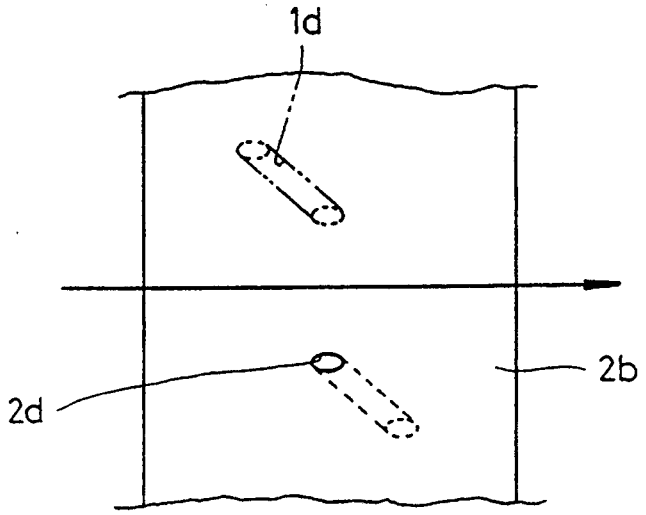
FIG. 10 is an arrangement drawing of the fluid conduits when the nozzle plate of the second component is viewed from above under the condition of FIG. 9.

Further, as shown in FIG. 9 and FIG. 10, the same effect can be obtained when the fluid conduit 1*d* of the fluid conduits 1*d* and 2*d* is oriented in the yarn running direction or when the fluid conduit 2*d* is oriented in the downstream side with respect to the yarn running direction as shown by the arrowhead.

Figure 11:
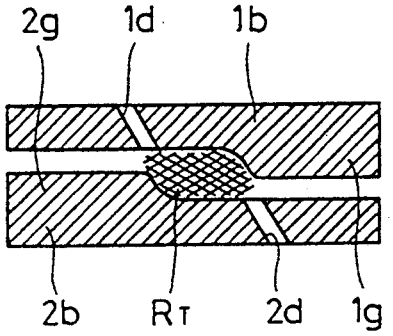
FIG. 11 is a cross-sectional view showing a modification of the nozzle plates of the apparatus.

Further preferably, the nozzle plates 1*b* and 2*b*, which constitute the inner walls 1*e* and 2*e* of the first and second components 1 and 2 are provided with projecting walls 1*g* and 2*g* which juts out toward their associated nozzle plates 1*b* and 2*b* at the portions adjacent to the surface which constitutes the major part for forming the yarn treating region $R_T$ in the section orthogonal with the yarn running direction as shown in FIG. 11.

Providing such projecting walls 1*g* and 2*g* clearly defines the yarn treating region $R_T$ by the inner walls 1*e* and 2*e* of the two plates 1*b* and 2*b* and the fluid conduits 1*d* and 2*d* and it also properly restricts the flow of the pressurized air ejecting from the fluid conduits 1*d* and 2*d*. The result is enhanced coherence of yarn.

Figure 12:
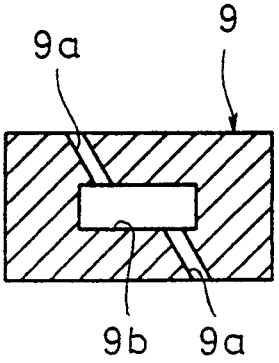
FIG. 12 shows another modification of the nozzle plate of the apparatus and it is a cross-sectional view of a nozzle component which is made integral with the nozzle plates.

Furthermore, as shown in FIG. 12, the nozzle plates 1*b* and 2*b* may be made into one piece and a cylindrical nozzle component 9 with fluid conduits 9*a* and 9*a* opened in a central yarn running space 9*b* may be used. In this case, the fluid conduits 9*a* and 9*a* are provided with a gap between their axes and are inclined so that the fluid is jetted out toward the yarn running space 9*b* which serves as the yarn treating region. This should help reduce the number of components that make up the apparatus for treating yarn with fluid.

EXAMPLE 1

In the apparatus shown in FIG. 1 through FIG. 3, wherein the inner walls 1*e* and 2*e* having the fluid conduits 1*d* and 2*d* of the nozzle plates opened are flat planes, the diameter of the fluid conduits 1*d* and 2*d* was set to 1.6 mm, the horizontal distance E between the axes $A_{L1}$ and $A_{L2}$ of the fluid conduits 1*d* and 2*d* was set to 5 mm, the gap G between the nozzle plates 1*b* and 2*b* was set to 2 mm, and the angle $\theta$ of the fluid conduits 1*d* and 2*d* inclined against the nozzle plates 1*b* and 2*b* was set to 60°, and a nylon yarn consisting of 420 deniers and 72 filaments was allowed to run at a yarn speed of 1,000 m/min. to interlace the yarn by ejecting a pressurized air of 4 kg/cm$^2$.G from the fluid conduits 1*d* and 2*d*. At this time, the treating tension of the nylon yarn was 20 g.f before it was subjected to the treating apparatus and 50 g.f after it was subjected to the interlacing.

As a result, the monofilaments constituting the nylon yarn were effectively provided with opened and interlaced portions, producing a yarn which features a high level of coherence, i.e., 28 firm interlaced portions per meter.

EXAMPLE 2

In the apparatus shown in FIGS. 1 to 3 wherein the inner walls to which the fluid conduits 1*d* and 2*d* of the nozzle plates 1*b* and 2*b* open were made flat, the diameter of the fluid conduits 1*d* and 2*d* was set to 1.0 mm, the horizontal distance E between the axes $A_{L1}$ and $A_{L2}$ of the fluid conduits 1*d* and 2*d* was set to 7.4 mm, the gap G between the nozzle plates 1b and 2b was set to 2 mm, and the angle $\theta$ of inclination of the fluid conduits 1d and 2d with respect to the nozzle plates 1b and 2b was set to 30°, a Tetoron yarn of 75 deniers, consisting of 36 filaments, was allowed to run at a yarn speed of 1,000 m/min., with a treating tension of 5 g.f applied to the yarn, to interlace the yarn by ejecting pressurized air of 6 kg/cm$^2$.G from the fluid conduits 1d and 2d.

Figure 36:
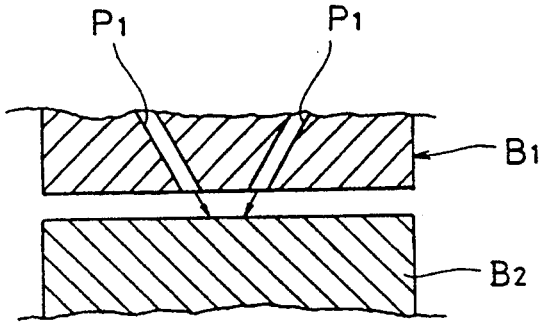
FIG. 36 (PRIOR ART)
FIG. 36 is a cross-sectional view which shows a conventional apparatus for treating yarn with fluid wherein the fluid conduits provided in one component are arranged aslant.
Figure 37:
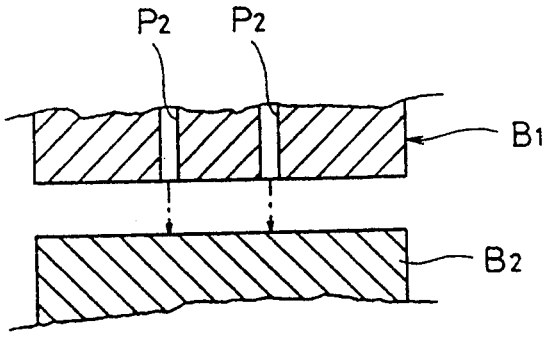
FIG. 37 (PRIOR ART)
FIG. 37 is a cross-sectional view which shows a conventional apparatus wherein the fluid conduits provided in one component are in parallel to each other and orthogonal with the inner wall.

For the purpose of comparison, a Tetoron yarn of 75 deniers consisting of 36 filaments was subjected to the interlacing process under the same treatment conditions, using the yarn treating apparatus shown in FIG. 36.

As a result, the monofilaments of the Tetoron yarn interlaced by using the apparatus of the present example were effectively provided with opened and interlaced portions, and had 16.3 firm interlaced portions per meter. In contrast, the Tetoron yarn interlaced using the apparatus shown in FIG. 36 had only 12.0 firm interlaced portions per meter.

The second embodiment related to the first invention of the present invention, wherein sub fluid conduits which face against each other are provided between the axes of the fluid conduits, will now be explained in detail with reference to FIG. 13 through FIG. 22.

Figure 13:
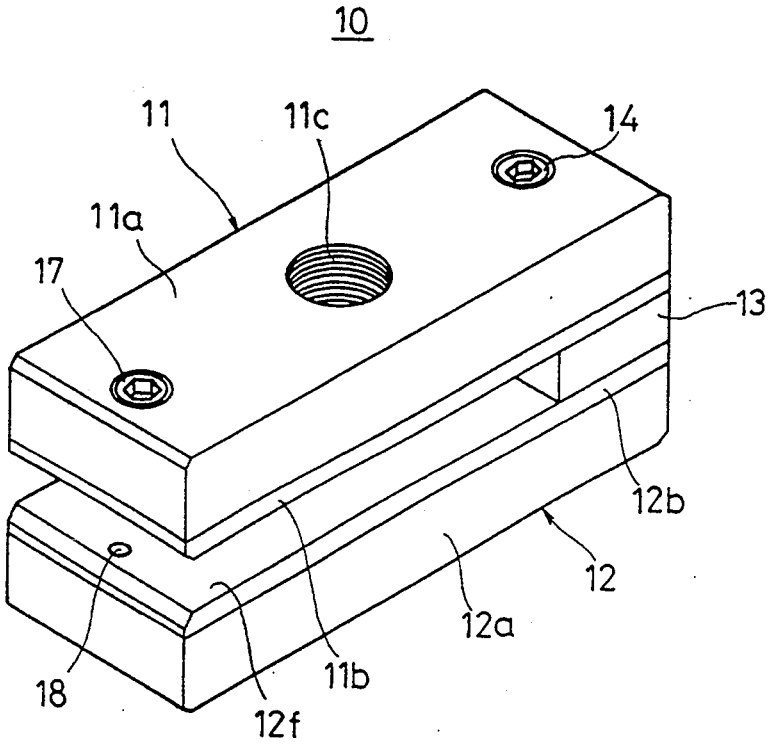
FIG. 13 is a perspective view of the apparatus for treating yarn with fluid related to the second embodiment of the first invention of the present invention.
Figure 14:
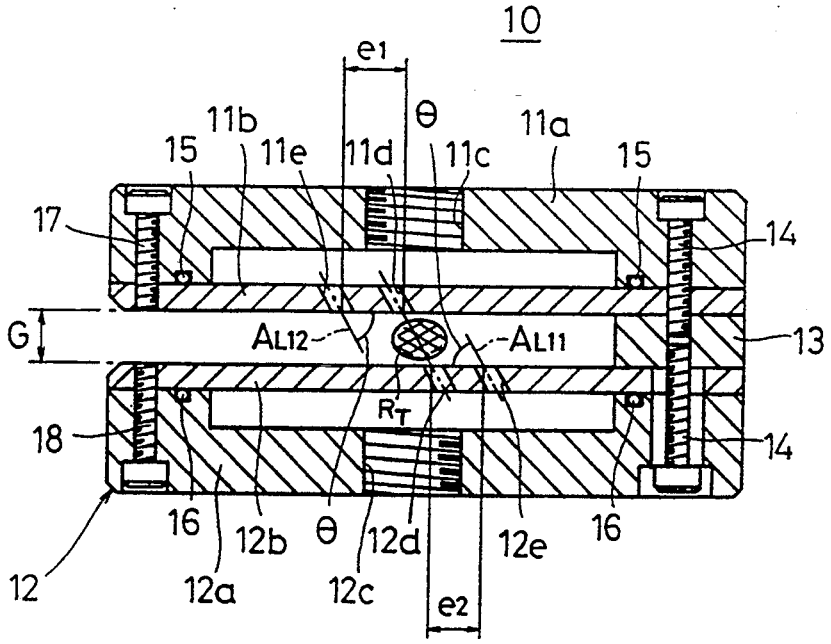
FIG. 14 is a front view showing a section of the apparatus of FIG. 13.
Figure 15:
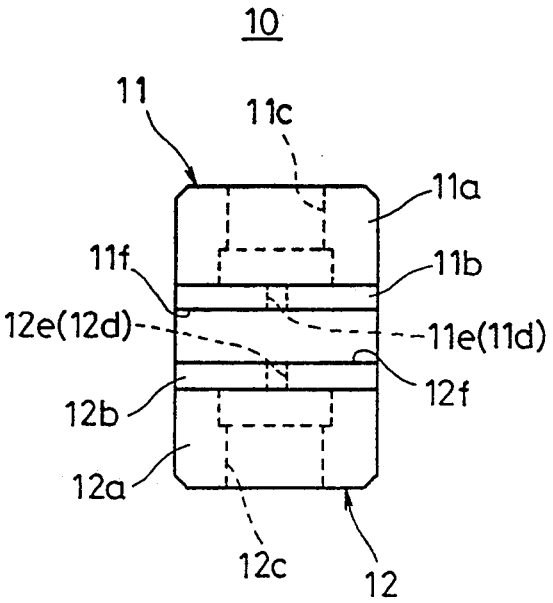
FIG. 15 is a left side view of the apparatus of FIG. 13.

In the apparatus 10 according to the embodiment, as shown in FIG. 13 through FIG. 15, the first component 11 and the second component 12 are fixed with bolts 14 and 14 via a spacer 13.

As shown in FIG. 14 which illustrates the section which is substantially orthogonal with the running direction of the yarn, the nozzle plates 11b and 12b of the first component 11 and the second component 12 are mounted on main bodies 11a and 12a with bolts 14, 17 and bolts 14, 18 via sealing materials, e.g., O rings 15 and 16. The main bodies 11a and 12a are provided with connection holes 11c and 12c. Further, the nozzle plates 11b and 12b are provided with a sub fluid conduit 11d and a fluid conduit 11e and a sub fluid conduit 12d and a fluid conduit 12e which are opened in the inner walls 11f and 12f and which are in parallel to each other.

As shown in FIG. 14, the sub fluid conduits 11d and 12d are inclined against the nozzle plates 11b and 12b by the angle $\theta$ and are oriented so that they face against each other with their axes aligned.

As shown in FIG. 14, the fluid conduits 11e and 12e form the yarn treating region $R_T$ for interlacing yarn with the axes $A_{L11}$ and $A_{L12}$ and the inner walls 11f and 12f of the nozzle plates 11b and 12b. The fluid conduits 11e and 12e are provided with a gap between the axes $A_{L11}$ and $A_{L12}$ and are inclined so that the fluid is ejected toward the yarn treating region $R_T$.

Accordingly, as shown in FIG. 14, the sub fluid conduits 11d and 12d and the fluid conduits 11e and 12e are arranged so that the angle $\theta$ formed by the inner walls 11f and 12f of the nozzle plates 11b and 12b, which inner walls 11f and 12f constitute the major part for producing the yarn treating region $R_T$, and the axes $A_{L11}$ and $A_{L12}$ becomes 90° or less.

In the apparatus described above, pressurized air is supplied to the connection holes 11c and 12c from a fluid supplying source like a pressurized air source, not shown, while allowing the yarn, which is to be interlaced, to run through the gap formed by the nozzle plates 11b and 12b. Then, the pressurized air passes through the sub fluid conduits 11d and 12d and fluid conduits 11e and 12e, then it ejects out aslant toward the nozzle plates 11b and 12b facing against each other.

Thus, the yarn vibrates two-dimensionally while it runs and it is effectively interlaced in the yarn treating region $R_T$ by the pressurized air ejected from the sub fluid conduits 11d and 12d and the fluid conduits 11e and 12e. Since the sub fluid conduits 11d and 12d and the fluid conduits 11e and 12e are located aslant to the nozzle plates 11b and 12b, the ejecting pressurized air bumps aslant against the running yarn. This increases the chances of the yarn crossing the pressurized air, leading to high coherence of the yarn.

Moreover, even if the yarn, which vibrates two-dimensionally, laterally jumps out of the yarn treating region $R_T$ shown in FIG. 14, the yarn is drawn back into the yarn treating region $R_T$ by the horizontal component force of the pressurized air ejecting from the fluid conduits 11e and 12e, thereby effectively restraining the yarn from jumping out of the fluid conduits 11e and 12e shown in FIG. 14.

In addition, the gap G (see FIG. 14) between the components 11 and 12 can be changed by adjusting the thickness of a spacer 13 in accordance with the type of yarn to be interlaced.

In this case, each of the sub fluid conduits 11d and 12d, which face against each other, may be provided at least one in each of the nozzle plates 11b and 12b.

Also, each of the fluid conduits 11e and 12e may be provided at least one in each of the nozzle plates 11b and 12b. The horizontal distance between them varies depending on the gap G between the first and second components 11 and 12, which face against each other, and the type of yarn to be interlaced.

The sub fluid conduits 11d and 12d and the fluid conduits 11e and 12e have, for example, a round section, however, the configuration is not limited to the round section; it is needless to say that its configuration may be an ellipse or a polygon such as a triangle or quadrangle.

Preferably, the major part, which constitutes the yarn treating region $R_T$, of inner walls 11f and 12f of the nozzle plates 11b and 12b facing against each other has a flat plane. This allows the pressurized air ejected from the sub fluid conduits 11d and 12d to be smoothly discharged along the inner walls 11f and 12f of the nozzle plates 11b and 12b without its flow being blocked. Thus, the loss in the energy of the pressurized air ejected from the sub fluid conduits 11d and 12d is minimized and the dynamic pressure of the ejecting pressurized air can be effectively used for interlacing.

A horizontal displacement $e_1$ of the fluid conduit 11e with respect to the fluid conduit 11d and a horizontal displacement $e_2$ of the fluid conduit 12e with respect to the fluid conduit 12d (see FIG. 14) are set to a value between 1.5 times and 6 times, preferably between 2 times and 4 times the inner diameter, $d_0$, of the sub fluid conduits 11d and 12d.

Figure 16:
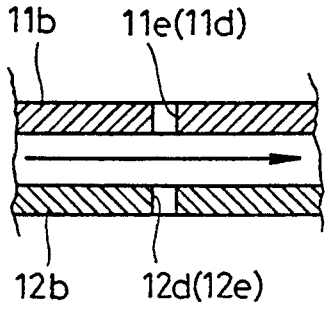
FIG. 16 is a cross-sectional view which schematically shows the fluid conduits which are provided in the nozzle plates of the apparatus and which are laid out so that they are substantially orthogonal with the yarn running direction in the section of the yarn running direction.
Figure 17:
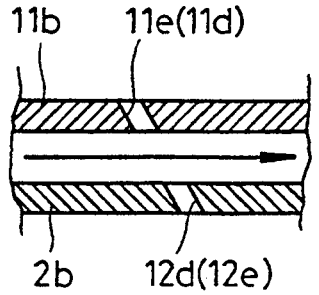
FIG. 17 is a cross-sectional view which schematically shows the fluid conduits which are provided in the nozzle plates of the apparatus and which are inclined backward against the yarn running direction.
Figure 18:
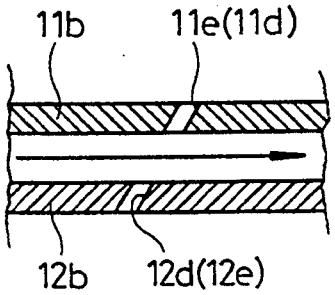
FIG. 18 is a cross-sectional view which schematically shows the fluid conduits which are provided in the nozzle plates of the apparatus and which are inclined forward against the yarn running direction.

Preferably, the sub fluid conduits 11d and 12d and the fluid conduits 11e and 12e provided in the nozzle plates 11b and 12b of the first and second components 11 and 12 are oriented so that they are substantially orthogonal with the yarn running direction shown by the arrowhead in the section in the yarn running direction as shown in FIG. 16 or they are inclined against the yarn running direction shown by the arrowhead in FIG. 17 and FIG. 18.

Figure 19:
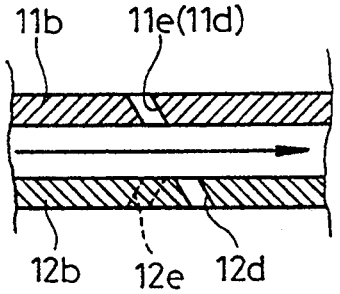
FIG. 19 is a cross-sectional view which schematically shows another example wherein the fluid conduits provided in the nozzle plates of the apparatus are inclined against the yarn running direction.

When the sub fluid conduits 11d and 12d and the fluid conduits 11e and 12e are inclined against the yarn running direction, as shown in FIG. 19, for example, the sub fluid conduit 11d and the fluid conduits 11e and 12e maybe inclined so that the pressurized air is ejected in the yarn running direction and the sub fluid conduit 12*d* may be inclined so that the pressurized air is ejected in the opposite direction from the yarn running direction.

Figure 20:
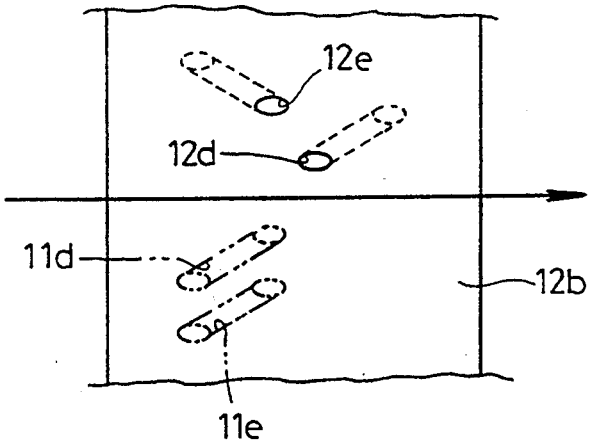
FIG. 20 is an arrangement drawing of the fluid conduits when the nozzle plate of the second component is viewed from above under the condition of FIG. 19.

At this time, as shown in FIG. 20 which illustrates the opening of the fluid conduits 12*d* and 12*e* of the nozzle plate 12*b* observed from above, the sub fluid conduits 11*d* and 12*d* and the fluid conduit 11*e* are located in parallel to each other, while the fluid conduit 12*e* is located axially symmetrical to the fluid conduit 11*e* with respect to the line indicated by the arrowhead showing the yarn running direction.

In this case, the orientations of the sub fluid conduit 11*d* and the fluid conduit 11*e* are shown overlapped on FIG. 20 using long and two short dash lines when they are observed from above where the pressurized air flows in. The same illustration applies to FIG. 8, FIG. 10, and FIG. 22.

Hence, even when the sub fluid conduits 11*d* and 12*d* and the fluid conduits 11*e* and 12*e* are located as explained above, the frequency that the yarn crosses the pressurized air is increased and the jumping-out of yarn can be prevented in the same manner as previously described.

Figure 21:
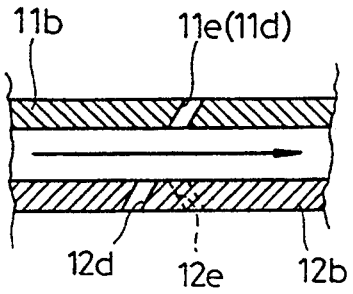
FIG. 21 is a cross-sectional view which schematically shows another example wherein the fluid conduits provided in the nozzle plates of the apparatus are inclined against the yarn running direction.
Figure 22:
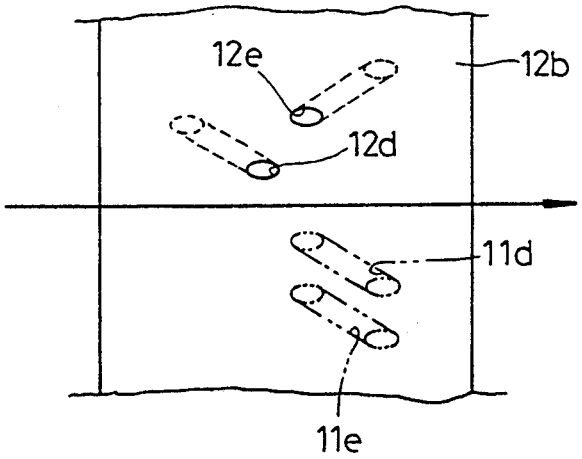
FIG. 22 is an arrangement drawing of the fluid conduits when the nozzle plate of the second component is viewed from above under the condition of FIG. 21.

In addition, reversely from the above, as shown in FIG. 21 and FIG. 22, the sub fluid conduit 11*d* and the fluid conduits 11*e* and 12*e* may be inclined so that the pressurized air is ejected in the opposite direction from the yarn running direction, while the sub fluid conduit 12*d* is inclined so that the pressurized air is ejected in the yarn running direction. In this case, as shown in FIG. 22 which illustrates the opening of the fluid conduits 12*d* and 12*e* of the nozzle plate 12*b* observed from above, the sub fluid conduits 11*d* and 12*d* and the fluid conduit 11*e* are located in parallel to each other, while the fluid conduit 12*e* is located axially symmetrical to the fluid conduit 11*e* with respect to the line indicated by the arrowhead showing the yarn running direction, and the same effect as that previously described is obtained.

EXAMPLE 3

In the apparatus shown in FIG. 13 through FIG. 15, wherein the inner walls 11*f* and 12*f* having the sub fluid conduits 11*d* and 12*d* and the fluid conduits 11*e* and 12*e* of the nozzle plates 11*b* and 12*b* opened are flat planes, the diameter of the sub fluid conduits 11*d* and 12*d* and the fluid conduits 11*e* and 12*e* was set to 1.6 mm, the horizontal distance between the axes of the adjoining fluid conduits 11*d*, 11*e* and fluid conduits 12*d*, 12*e*, that is, the displacements $e_1$, $e_2$, were set to 5 mm, the gap G between the nozzle plates 11*b* and 12*b* was set to 2 mm, and the angle $\theta$ of the sub fluid conduits 11*d*, 12*d* and the fluid conduits 11*e*, 12*e* inclined against the nozzle plates 11*b* and 12*b* was set to 60°, and a nylon yarn consisting of 420 deniers and 72 filaments was allowed to run at a yarn speed of 1,000 m/min. to interlace the yarn by ejecting a pressurized air of 4 kg/cm$^2$.G from the sub fluid conduits 11*d*, 12*d* and the fluid conduits 11*e*, 12*e*.

As a result, the monofilaments constituting the nylon yarn were effectively provided with opened and interlaced portions, producing a yarn which features a high level of coherence, i.e., 27 to 34 firm interlaced portions per meter and the yarn was effectively prevented from jumping out of the fluid conduits 11*e* and 12*e* during the interlacing process.

EXAMPLE 4

In the apparatus shown in FIGS. 13 through 15, the diameter of the sub fluid conduits 11*d* and 12*d* and the diameter of the fluid conduits 11*e* and 12*e* were individually set to 1.0 mm, the displacement $e_1$ between the axes of the adjoining fluid conduits 11*d*, 11*e* and the displacement $e_2$ between the axes of the adjoining fluid conduits 12*d*, 12*e* were set to 1.5 mm, the gap G between the nozzle plates 11*b* and 12*b* was set to 2 mm, and the angle $\theta$ of inclination of the sub fluid conduits 11*d*, 12*d* and the fluid conduits 11*e*, 12*e* with respect to the nozzle plates 11*b* and 12*b* was set to 60°. A Tetoron yarn of 300 deniers, consisting of 96 filaments, was allowed to run at a yarn speed of 1,000 m/min., with a treating tension of 60 g.f applied to the yarn, to interlace the yarn by ejecting pressurized air of 2.8 kg/cm$^2$.G from the sub fluid conduits 11*d*, 12*d* and the fluid conduits 11*e*, 12*e*.

For the purpose of comparison, a Tetoron yarn of 300 deniers consisting of 96 filaments was subjected to the interlacing process under the same treatment conditions, using the yarn treating apparatus shown in FIG. 36. In order to make the quantity of pressurized air equal, pressurized air was ejected at 6 kg/cm$^2$.G for the interlacing process.

As a result, the monofilaments of the Tetoron yarn interlaced by using the apparatus of the present example were effectively provided with opened and interlaced portions, and had 27.0 firm interlaced portions per meter. In contrast, the Tetoron yarn interlaced using the apparatus shown in FIG. 36 had only 13.5 firm interlaced portions per meter.

An embodiment related to the second invention of the present invention, wherein a plurality of fluid conduits are provided facing against each other, will now be explained in detail with reference to FIG. 23 through FIG. 35.

Figure 23:
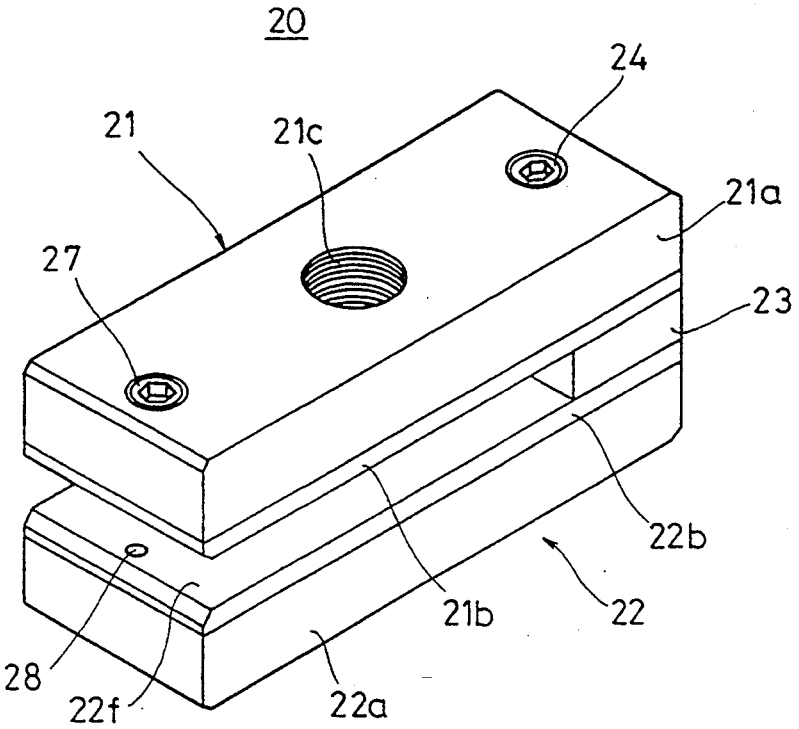
FIG. 23 is a perspective view of the apparatus for treating yarn with fluid related to the second invention of the present invention.
Figure 24:
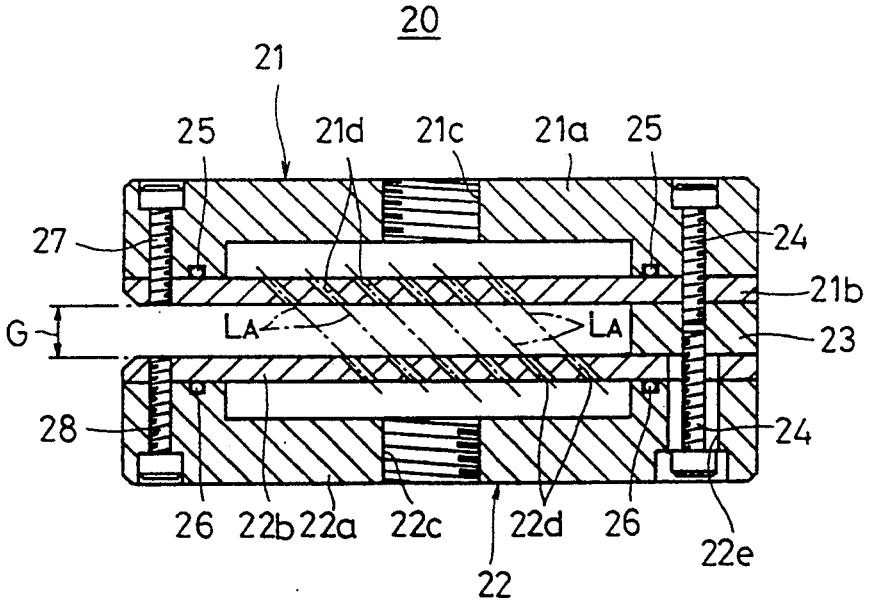
FIG. 24 is a front view of the section of the apparatus of FIG. 23.
Figure 25:
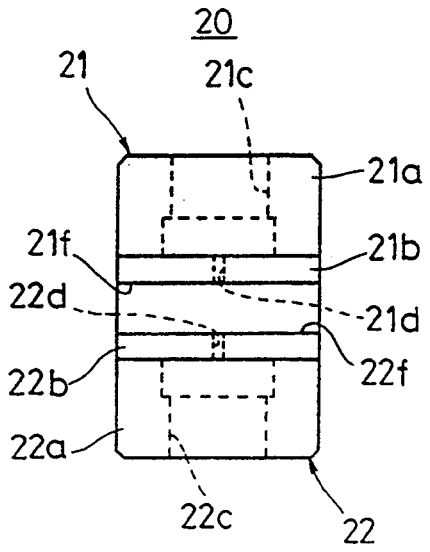
FIG. 25 is a left side view of the apparatus of FIG. 23.

In the apparatus 20 according to the embodiment, as shown in FIG. 23 through FIG. 25, the first component 21 and the second component 22 are fixed with bolts 24 and 24 via a spacer 23.

As shown in FIG. 24 which illustrates the section which is substantially orthogonal with the running direction of the yarn, the nozzle plates 21*b* and 22*b* of the first component 21 and the second component 22 are mounted on main bodies 21*a* and 22*a* with bolts 24, 27 and bolts 24, 28 via sealing materials, e.g., O rings 25 and 26. The main bodies 21*a* and 22*a* are provided with connection holes 21*c* and 22*c*, while the nozzle plates 21*b* and 22*b* are provided with a plurality of fluid conduits 21*d* and 22*d*.

A plurality of fluid conduits 21*d* and 22*d* are opened in the inner walls 21*f* and 22*f* (see FIG. 25) of the nozzle plates 21*b* and 22*b*, respectively, as shown in FIG. 24, and they are arranged so that they face against each other and they are inclined against each other. In addition, the plurality of fluid conduits 21*d* and 22*d* are laid out in parallel between the axes $L_A$ of adjoining fluid conduits with specified intervals.

Figure 27:
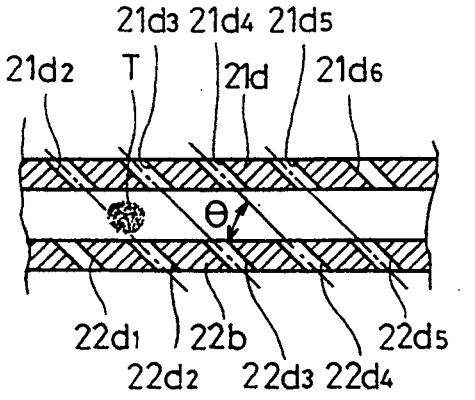
FIG. 27 is a cross-sectional view which illustrates the inclination of the fluid conduits provided in the nozzle plates of the apparatus in the plane orthogonal with the yarn running direction.

Accordingly, for example, the fluid conduits $21d_2$ through $21d_6$ and $22d_1$ through $22d_5$ are provided so that the axes of the fluid conduits $21d_2$ through $21d_6$ and $22d_1$ through $22d_5$ are inclined by an acute angle $\theta$ against the nozzle plate 22*b* as shown in FIG. 27 cut with a plane which is orthogonal with the running direction of a yarn T. Inclining the fluid conduits like this makes it easier for the yarn to laterally vibrate by the ejecting fluid, leading to enhanced interlacing performance.

More specifically, in FIG. 27, when a part of the yarn T is located between the fluid conduits $21d_2$, $22d_2$ and the fluid conduits $21d_3$, $22d_3$, which face against each other, if a plurality of filaments constituting the part of the yarn T move to the left from the fluid jetting area of the fluid conduits $21d_2$, $22d_2$, then the force of the fluid ejecting from the fluid conduit $21d_2$ and the tension of the filaments together generate a force that moves the filaments back (to the right) since the fluid conduits $21d_2$ and $22d_2$ are inclined by $\theta$.

This phenomenon applies to all filaments and consequently, each single yarn exhibits lateral chord vibration in the cross section of the apparatus, for example, shown in FIG. 27 and they are interlaced with each other.

Thus, in the apparatus 20 of the embodiment, the axes $L_{A21}$ and $L_{A22}$ of the fluid conduits 21*d* and 22*d* located on the outermost side of the plurality of fluid conduits 21*d* and 22*d* and the nozzle plates 21*b* and 22*b* form a wide yarn treating region between the nozzle plates 21*b* and 22*b* for interlacing the yarn.

The second component 22 has an elliptic inserting hole 22*e* in which a bolt 24 of a main body 22*a* and the nozzle plate 22*b* is inserted. This makes it possible to slightly adjust the arranging direction of the fluid conduits 21*d* and 22*d* which face against each other in the apparatus 20 of this embodiment.

In the apparatus 20 described above, pressurized air is supplied to connection holes 21*c* and 22*c* from a fluid supplying source like a pressurized air source, not shown, while allowing the yarn, which is to be interlaced, to run through the gap formed by the first and second components 21 and 22. Then the pressurized air passes through a plurality of the fluid conduits 21*d* and 22*d* and ejects out.

Thus, the yarn is interlaced by the pressurized air which ejects out through the fluid conduits 21*d* and 22*d* facing against each other.

In this case, the gap G (see FIG. 24) between the components 21 and 22 can be changed by adjusting the thickness of the spacer 23.

In this embodiment, it is necessary to provide at least two fluid conduits 21*d* and 22*d* in each of the nozzle plates 21*b* and 22*b*. The horizontal distance between the axes $L_A$ and $L_A$ of the fluid conduits 21*d* and 22*d* facing against each other varies depending on the gap provided between the first and second components 21 and 22 facing against each other and the type of yarn to be interlaced.

The fluid conduits 21*d* and 22*d* have, for example, a round section, however, the configuration is not limited to the round section; it is needless to say that its configuration-may be an ellipse or a polygon such as a triangle or quadrangle.

Preferably, the said plurality of fluid conduits 21*d* and 22*d* are provided with their axes displaced so that the fluid conduits 21*d* and 22*d* facing against each other share a common area where they overlap in a plane of projection which is perpendicular to the axial direction of the fluid conduits 21*d* and 22*d*.

Figure 26:
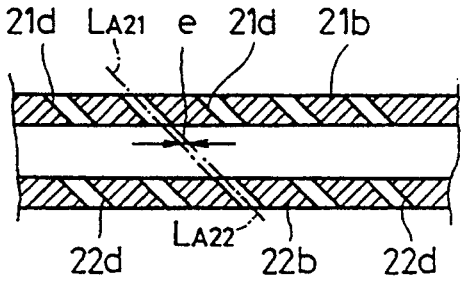
FIG. 26 is a cross-sectional view which illustrates the displacement of the fluid conduits provided in the nozzle plates of the apparatus in the plane orthogonal with the yarn running direction.

More specifically, as shown in FIG. 26, for instance, the axis $L_{A21}$ of the fluid conduits 21*d* provided in the nozzle plate 21*b* and the axis $L_{A22}$ of the corresponding fluid conduit 22*d* provided in the nozzle plate 22*b* are horizontally displaced. The displacement "e" depends on the horizontal distance between the corresponding fluid conduits 21*d* and 22*d* and the size of the fluid conduits. More preferably, the displacement "e" is set so that the projection area in the plane of projection perpendicular to the axial direction ranges from 50% to 100%.

Further preferably, in the first and second components 21 and 22, the inner walls 21*f* and 22*f* of the nozzle plates 21*b* and 22*b* in which a plurality of fluid conduits 21*d* and 22*d* are opened have flat surfaces.

Figure 28:
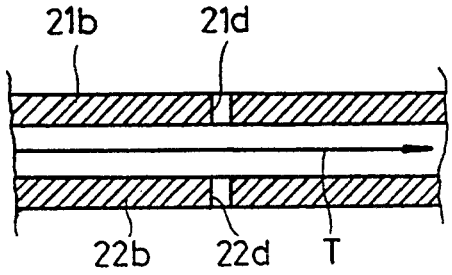
FIG. 28 is a cross-sectional view which schematically shows the fluid conduits which are provided in the nozzle plates of the apparatus and which are oriented so that they are substantially orthogonal with the yarn running direction in the section of the yarn running direction.
Figure 29:
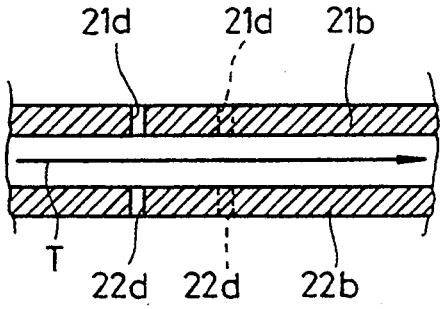
FIG. 29 is a cross-sectional view which schematically shows the fluid conduits which are provided in the nozzle plates of the apparatus and which are provided with gaps between them with respect to the yarn running direction.

In addition, the fluid conduits opened in the first and second components 21 and 22 may be provided so that the fluid conduits 21*d* and 22*d* facing against each other are substantially orthogonal with the running direction of the yarn T as shown in FIG. 28 wherein the nozzle plates 21*b* and 22*b* are cut along the running direction of the yarn T, or they may be provided in the running direction of the yarn T with intervals given between them as shown in FIG. 29.

Figure 30:
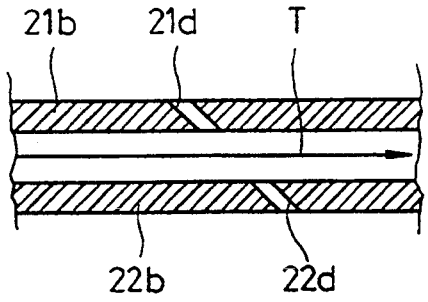
FIG. 30 is a cross-sectional view which schematically shows the fluid conduits which are provided in the nozzle plates of the apparatus and which are provided aslant to the yarn running direction in the section of the yarn running direction.
Figure 31:
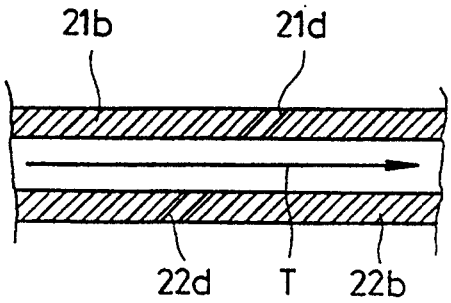
FIG. 31 is a cross-sectional view which schematically shows the fluid conduits which are provided in the nozzle plates of the apparatus and which are inclined against the yarn running direction.
Figure 32:
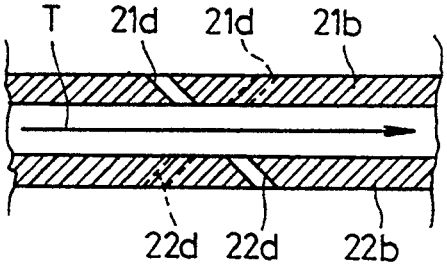
FIG. 32 is a cross-sectional view which schematically shows the fluid conduits which are provided in the nozzle plates of the apparatus and which are inclined against each other with respect to the yarn running direction.

Further, as shown in FIGS. 30 and 31, the fluid conduits 21*d* and 22*d* may be formed such that each pair of fluid conduits 21*d* and 22*d*, aligned with each other, extends aslant with respect to the running direction of the yarn T. Alternatively, the fluid conduits 21*d* and 22*d* may be laid out in such a manner that adjacent pairs of fluid conduits 21*d* and 22*d*, individually aligned with each other, extend crossways in different directions, as shown in FIG. 32.

Figure 33:
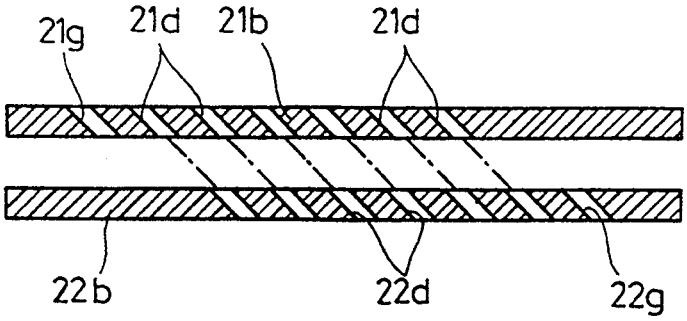
FIG. 33 is a cross-sectional view which schematically shows fluid conduits which have been added outside a plurality of fluid conduits provided in the apparatus.

Further preferably, like the nozzle plates 21*b* and 22*b* shown in FIG. 33, the aforesaid first and second components 21 and 22 are provided with additional fluid conduits 21*g* and 22*g*, one each, for ejecting a fluid to a running yarn, the additional fluid conduits 21*g* and 22*g* being located outside the plurality of fluid conduits 21*d* and 22*d*.

This prevents the yarn from moving out of the area between the components 21 and 22 because the fluid ejected from the additional fluid conduits 21*g* and 22*g* located in the outermost position blows the yarn, which is positioned between the first and second components 21 and 22, toward the central area between the components 21 and 22.

Figure 34:
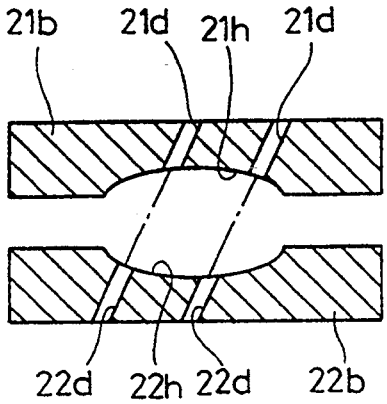
FIG. 34 is a cross-sectional view which schematically shows a case wherein the fluid conduits provided in the nozzle plates of the apparatus are opened in a recess formed in the yarn running direction.

Alternatively, the first and second components 21 and 22 may be provided with recesses 21*h* and 22*h*, between which the yarn runs, the recesses being made in the inner walls of the nozzle plates 21*b* and 22*b* as shown in FIG. 34 which illustrates the components cut by a plane orthogonal with the yarn running direction.

Figure 35:
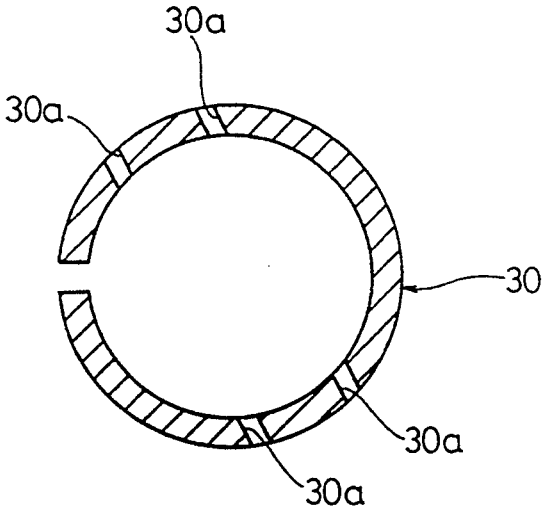
FIG. 35 is a cross-sectional view which shows a case wherein the nozzle plate of the apparatus is made of a single C-shaped cylindrical nozzle component.

Further alternatively, as shown in FIG. 35, the nozzle plates 21*b* and 22*b* may be combined into a cylindrical nozzle component 30 which has a C-shape cross section, and a fluid may be ejected from a plurality of fluid conduits 30*a* to interlace the yarn, the fluid conduits being provided in the nozzle component 30 and facing against each other.

This will secure an adequate area for running yarn and also an adequate yarn treating region.

EXAMPLE 5

In the apparatus 20 shown in FIG. 23 through FIG. 25, wherein the inner walls 21*f* and 22*f* having the fluid conduits 21*d* and 22*d* opened are flat planes, the diameter of the fluid conduits 21*d* and 22*d* was set to 1.6 mm, the horizontal distance between the adjoining fluid conduits 21*d* and 21*d* and between adjoining fluid conduits 22*d* and 22*d* were set to 5 mm, the gap G between the nozzle plates 21*b* and 22*b* was set to 10 mm, and the displacement "e" of the fluid conduits 21*d* and 22*d* facing against each other was set to 0 mm, 0.8 mm, and 2.5 mm, and a flat tow yarn of 64,000 deniers and 64,000 filaments was allowed to run at a yarn speed of 4 m/min. to interlace the yarn by ejecting a pressurized air of 2 kg/cm$^2$.G from the fluid conduits 21*d* and 22*d*.

As a result, the yarn was provided with interlaced portions, where the filaments were interlaced partially, and opened portions which are free of interlacing, and the interlaced portions were overlapped widthwise, thus providing the yarn with coherence wherein the yarn was interlaced as flat meshes of a net as a whole. The interlaced portions were not bundled roundly, which used to be a problem with the interlacing performed by the conventional apparatuses, thus proving improved coherence.

When the displacement "e" between the facing fluid conduits 21*d* and 22*d* was within the range of 0 to 0.8 mm (when the size of the projected common area of the fluid conduits was 50 to 100%), the yarn was interlaced into flat meshes of a net. However, when the displacement "e" was 2.5 mm (when the size of the common area of the fluid conduits was 0%), the filaments were not interlaced, failing to provide the tow yarn with coherence.

What is claimed is:

1. An apparatus for treating an as-spun multifilament yarn with fluid to interlace said filaments in order to provide said yarn with coherence, said apparatus comprising:

first and second components, which have inner walls arranged facing against each other with a specified gap provided between them, said first and second components are provided with at least one fluid conduit opening in each of said inner walls for delivering fluid to said gap provided between said first and second components, said fluid conduits form a yarn treating region with axes of said fluid conduits and said inner walls of said first and second components, a predetermined distance is provided between said axes of said fluid conduits and wherein the axes of said fluid conduits are in a section which is substantially orthogonal with a running direction of said yarn, said fluid conduits are inclined so that said fluid ejected from said fluid conduits is directed toward said yarn treating region.

2. The apparatus according to claim 1, wherein said inner walls of said first and second components have flat surfaces which constitute a major part of said yarn treating region.

3. The apparatus according to claim 1, wherein said fluid conduits are oriented so that they lie in a plane which is orthogonal with said running direction of said yarn.

4. The apparatus according to claim 1, wherein said fluid conduits are oriented aslant to said running direction of said yarn.

5. The apparatus according to claim 1, wherein said first and second components are provided with at least one sub fluid conduit for ejecting a fluid to said yarn treating region, which sub fluid conduits are provided between axes of said fluid conduits and which are arranged in parallel to said fluid conduits and face each other in a section which is substantially orthogonal with said running direction of said yarn.

6. The apparatus according to claim 5, wherein said inner walls of said first and second components have flat surfaces which constitute said major part of said yarn treating region.

7. The apparatus according to claim 5, wherein said fluid conduits and sub fluid conduits are oriented so that they lie in a plane which is orthogonal with said running direction of said yarn.

8. The apparatus according to claim 5 wherein said fluid conduits and sub fluid conduits are oriented aslant to said running direction of said yarn.

9. An apparatus for treating an as-spun multifilament yarn with fluid to interlace said filaments with each other, thereby providing said yarn with coherence, said apparatus comprising:

first and second components which have inner walls located facing against each other with a specified gap provided between them, said first and second components are provided with a plurality of fluid conduits for ejecting said fluid in a section, said section being substantially orthogonal with a running direction of said yarn, wherein said fluid conduits are opened in said respective inner walls, arranged opposing the fluid conduits on the opposing inner wall, and formed between axes of a pair of fluid conduits in parallel with one another and with a specified distance provided between them, wherein one of said pair of fluid conduits is disposed on the first component and a remaining one of said pair of fluid conduits is disposed on the second component.

10. The apparatus according to claim 9, wherein said plurality of fluid conduits are provided with their axes displaced so that said fluid conduits facing against each other share an overlapping area in a plane of projection which is perpendicular to said axial directions of respective fluid conduits.

11. The apparatus according to claim 10, wherein a size of said common area ranges from 50% to 100% of said projected area of said respective fluid conduits.

12. The apparatus according to claim 9, wherein said inner walls, in which said plurality of fluid conduits are opened, of said first and second components are flat surfaces.

13. The apparatus according to claim 9, wherein each of said first and second components has an additional fluid conduit for jetting said fluid toward said yarn, which additional fluid conduit is provided outside said plurality of fluid conduits facing against each other.

* * * * *